US007267334B2

(12) United States Patent
Koh et al.

(10) Patent No.: US 7,267,334 B2
(45) Date of Patent: Sep. 11, 2007

(54) ACTIVE MEDIA KICKER SYSTEM

(75) Inventors: Seng San Koh, Singapore (SG); Kok Chai Chong, Singapore (SG); Pui Wen Huang, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 604 days.

(21) Appl. No.: 10/860,819

(22) Filed: Jun. 3, 2004

(65) Prior Publication Data

US 2005/0269761 A1 Dec. 8, 2005

(51) Int. Cl.
*B65H 3/52* (2006.01)

(52) U.S. Cl. ..... 271/121; 271/122; 271/124

(58) Field of Classification Search ..... 271/121, 271/122, 124

See application file for complete search history.

(56) References Cited

U.S. PATENT DOCUMENTS

| | | | | |
|---|---|---|---|---|
| 5,316,285 | A * | 5/1994 | Olson et al. | 271/122 |
| 5,655,762 | A * | 8/1997 | Yergenson | 271/121 |
| 5,882,004 | A * | 3/1999 | Padget | 271/119 |
| 6,217,017 | B1 * | 4/2001 | Yamazaki | 271/121 |
| 2002/0175462 | A1 * | 11/2002 | Sonoda et al. | 271/121 |

* cited by examiner

*Primary Examiner*—David H Bollinger

(57) ABSTRACT

A kicker system comprises a rotatable roller for advancing media along a media path toward a print zone. A kicker is mounted on the roller for pivotal movement transverse to the rotational axis of the roller. A cam surface configured to engage the kicker during a portion of a rotation of the roller to thereby pivotably retract the kicker out of the media path. The kicker can be selectively actuated by controlling the relative rotation of the roller and the cam surface.

17 Claims, 10 Drawing Sheets

ACTIVE MEDIA KICKER SYSTEM

FIELD OF THE INVENTION

The present invention relates generally to systems for picking sheets of print media, and more particularly to kicker systems for preventing multiple sheet picks.

BACKGROUND OF THE INVENTION

Hard copy devices, such as inkjet printers, typically include a kicker to prevent multiple sheet picks, that is the picking of print media sheets underlying the top sheet in a stack of sheets. The kicker is conventionally used to kick the underlying sheets back into the stack.

In conventional systems, a kicker is spring biased in a kicking position before a pick. During a pick, the kicker is retracted by a kicker cam mounted on a pick roller. The kicker is kept retracted by contact with the top sheet as it advances through the printing zone. Once contact with the top sheet is lost, the kicker is spring biased back to the kicking position to kick any underlying sheets back into the stack.

The conventional kicker is disadvantageous because it is in contact with the media sheet during printing. This can cause print defects on the media such as scratch marks. The biasing force of the kicker creates drag on the media that can cause media misalignment problems such as skewing. If there are no following or underlying media sheets, the kicker will strike structures in the media path, such as a media-stopping feature, causing undesirable noise. The conventional kicker also performs a kicking motion for each pick sequence regardless of whether there is a multiple pick. Finally, the amount of kicking motion cannot be varied because the conventional kicker has a fixed length.

A need therefore exists for an active kicker system capable of selectively preventing multiple picks.

SUMMARY OF THE INVENTION

According to the present invention, there is provided a kicker system that includes a rotatable roller for advancing media along a media path toward a print zone, a kicker for kicking media in the media path away from the print zone, wherein the kicker is mounted on the roller for pivotal movement transverse to the rotational axis of the roller and a cam surface configured to engage the kicker during a portion of a rotation of the roller to thereby pivotably retract the kicker out of the media path wherein the kicker can be selectively actuated by controlling the relative rotation of the roller and the cam surface.

DESCRIPTION OF THE DRAWINGS

FIG. 4 shows a media sheet as it is first engaged by the converger.

FIG. 5 shows the next sequential step from FIG. 4 illustrating the kicker contacting the media sheet.

FIG. 6 shows the next sequential step from FIG. 5 where the kicker is in a retracted home position as the media sheet enters the print zone.

FIG. 7 shows a single printed media sheet exiting the print zone and multiple media sheets entering the media path.

FIG. 8 shows the next sequential step from FIG. 7 illustrating actuation of the kicker.

FIG. 9 shows the next sequential step from FIG. 8 where the kicker is actuated to kick the multiple media sheets out of the media path.

DETAILED DESCRIPTION OF THE EMBODIMENTS

Figure 1:
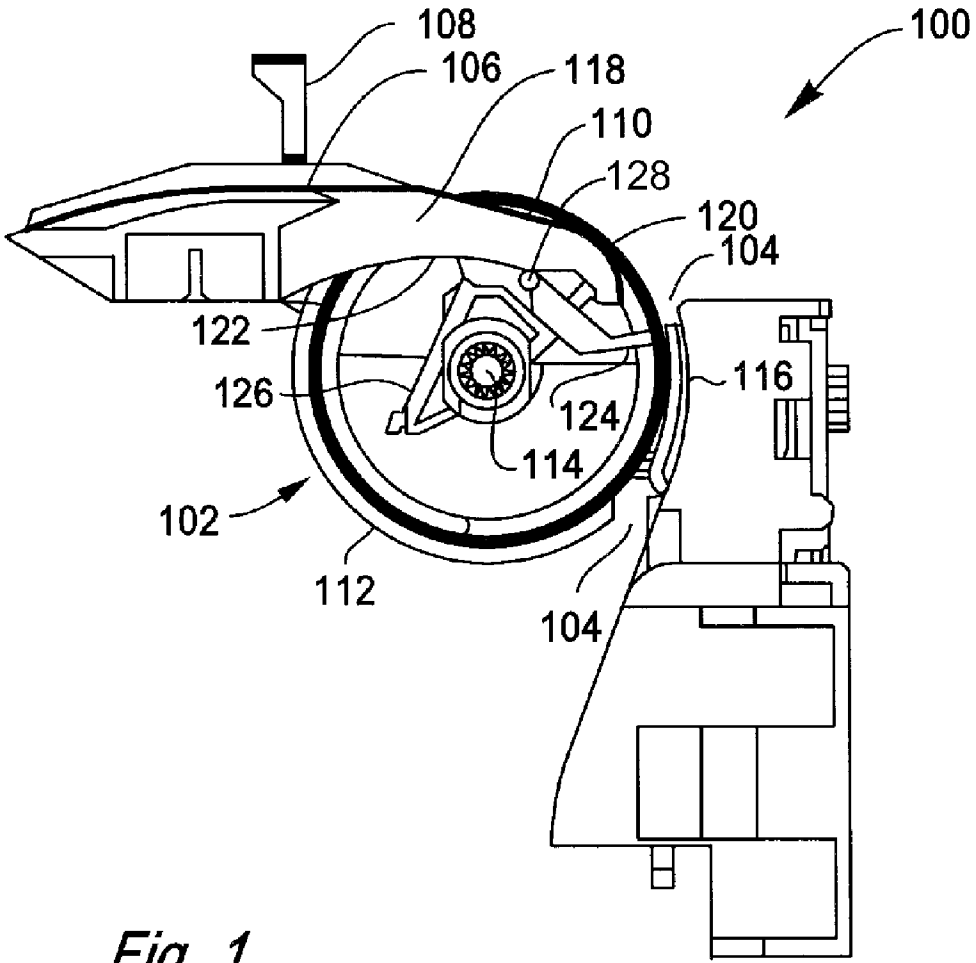
FIG. 1 is a partial side elevation view of an inkjet printer showing a kicker system according to an embodiment of the present invention.

FIG. 1 shows pertinent portions of an inkjet printer 100 in which an illustrated embodiment of the kicker system of the present invention may be used. The present invention may also be embodied in other hard copy devices, such as different types of printers, facsimile machines and scanners.

Referring to FIG. 1, many structural features of the inkjet printer 100 are omitted to clearly illustrate the invention. In pertinent part, inkjet printer 100 includes a rotatable converger assembly 102 for advancing media along a media path 104 to a print zone 106 beneath a moveable print head 108. Converger assembly 102 includes media guide wheels 110 and media drive wheels 112 mounted on a rotatable shaft 114 having an axis that extends transverse to the media path 104. Media path 104 is defined by a circumferential media guide surface 116 that is spaced apart from, and generally concentric with, guide wheels 110. A media guide projection 118 has an outer surface 120 configured to communicate with media path 104 to guide media toward print zone 106. Media guide projection 118 has an inner cam-contoured surface 122.

A kicker 124 is mounted via a frame 126 on converger shaft 114 to pivot transverse to the shaft axis. A pin 128 is provided on kicker 124 to slidably and pivotably engage with cam surface 122 during the portion of the rotation of converger 102.

Figure 2:
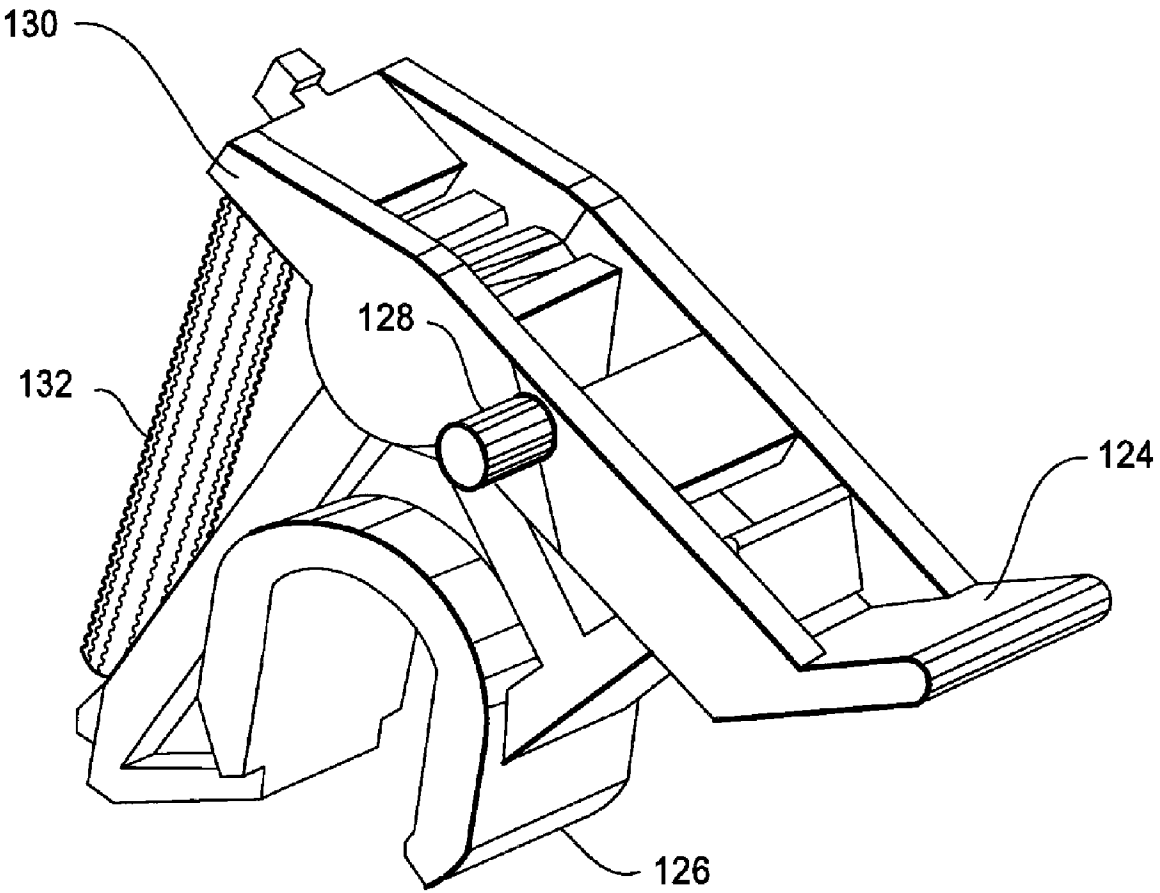
FIG. 2 is a perspective view of a kicker for use in the embodiment of FIG. 1.

Kicker 124 is illustrated separately in greater detail in FIG. 2. Kicker 124 is pivotably supported in frame 126 that is fixedly mountable on converger shaft 114. A proximal end 130 of kicker 124 is attached to the base of frame 126 by a spring 132 so that kicker 124 is spring biased to extend into media path 104.

Figure 3:
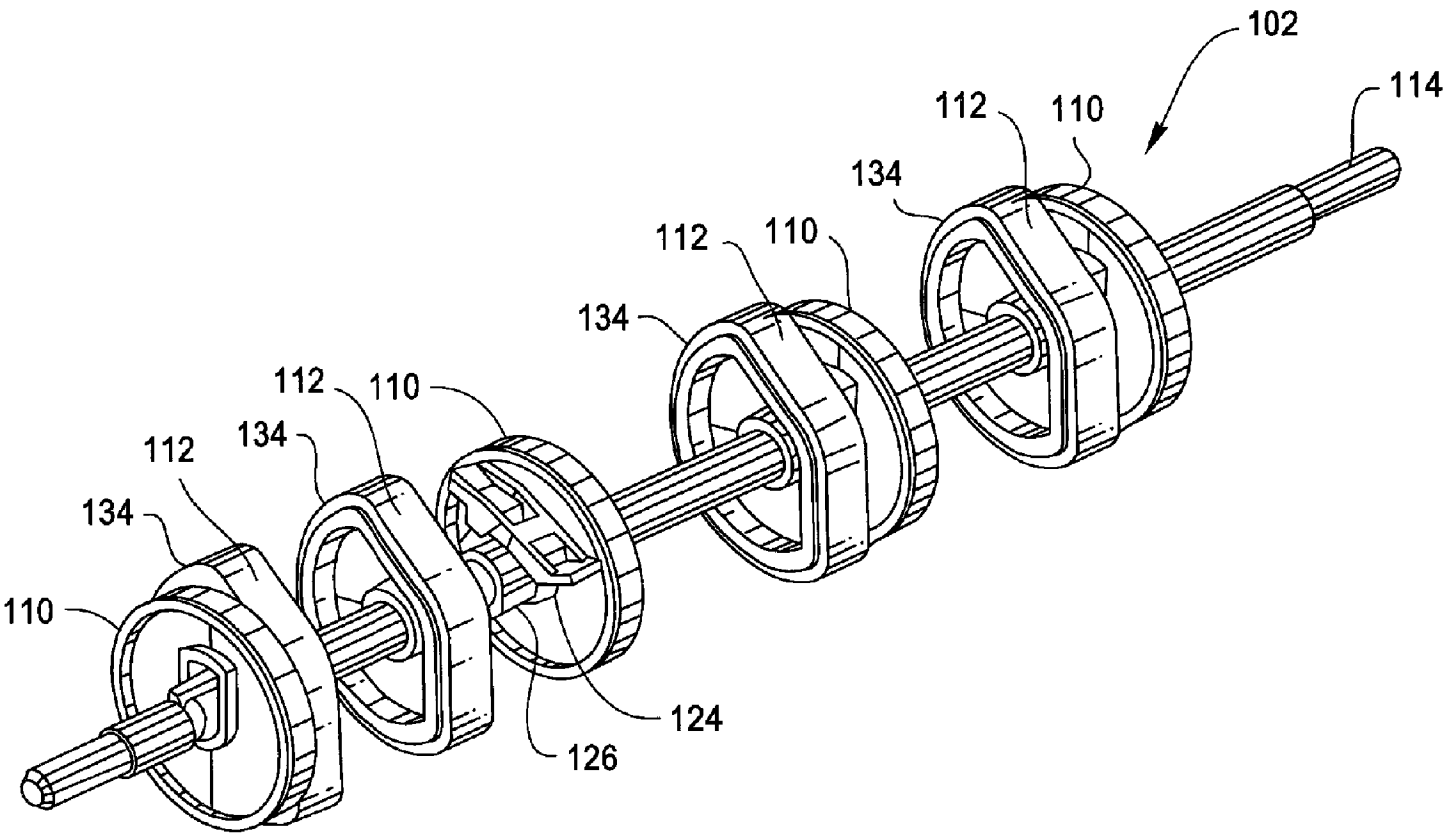
FIG. 3 is a perspective view of a converger for use in the embodiment of FIG. 1.

The converger assembly 102 is illustrated separately in greater detail in FIG. 3. The assembly includes a plurality of guide wheels 110 mounted adjacent a corresponding plurality of drive wheels 112. All the wheels are mounted on shaft 114 having an axis that extends transverse to media path 104 as defined above. Kicker 124 is pivotably supported in frame 126 that is fixedly mounted on shaft 114 between a guide wheel 110 and a drive wheel 112. The opposite outer ends of shaft 114 are rotatably mounted in a chassis (not shown). A servomotor (not shown) controlled by the printer controller (not shown) rotatably drives shaft 114 in a conventional manner, such as with a drive belt or gears.

Guide wheels 110 are mounted on shaft 114 so that they freely rotate on shaft 114 with minimal drag. Guide wheels 110 are configured to guide media along media path 104 toward print zone 106 with minimal frictional drag on the media. Conversely, drive wheels 112 are fixedly mounted to shaft 114 so that they rotate with shaft 114. Drive wheels 112 are configured to frictionally advance media along media path 104 to print zone 106.

In an embodiment, guide wheels 110 are cylindrical, whereas drive wheels 112 are generally D-shaped. The radius of the arcuate portion 134 of the D-shaped drive wheels 112 is greater than the radius of cylindrical guide wheels 110, and the remaining portions of D-shaped drive wheels 112 do not extend beyond the radius of cylindrical guide wheels 110.

Figure 4:
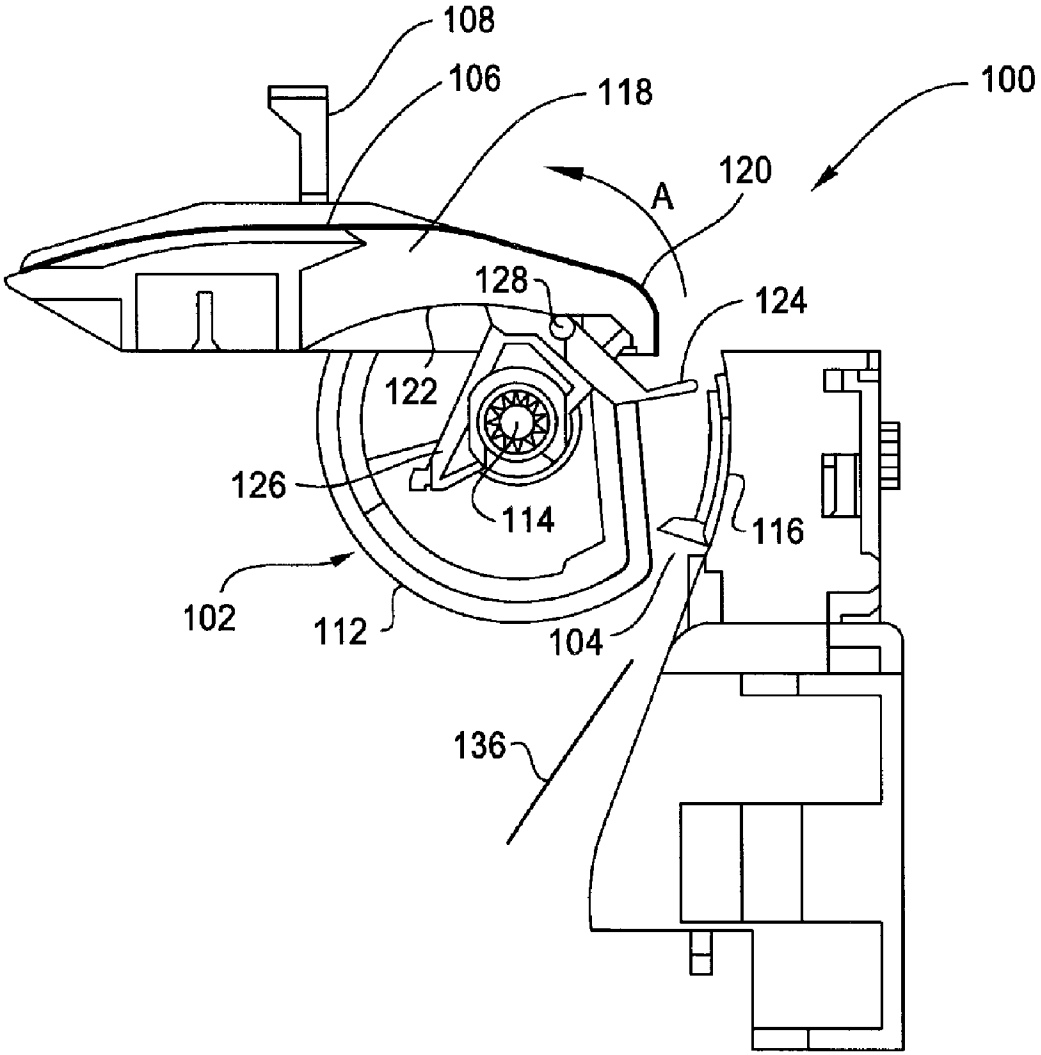
FIGS. 4 to 6 are a sequential series of side elevation views showing the kicker system of FIG. 1 in various positions as a media sheet is advanced along a media path toward a print zone in a printer.

The specific sequence of steps involved in the operation of the kicker system according to the illustrated embodiment will now be described starting with FIG. 4.

During normal single pick operation a sheet of media 136, which is typically paper, is picked from a stack of sheets an input tray (not shown) in a conventional manner, such as with pick rollers (not shown). Media sheet 136 is advanced by the pick rollers into media path 104. When a leading edge of media sheet 136 enters media path 104 between drive wheel 112 and guide surface 116, shaft 114 begins rotation in an anticlockwise direction shown by arrow A. Rotation of converger 102 starts with kicker 124 pivoted by cam surface 122 into a retracted home position out of media path 104.

Figure 5:
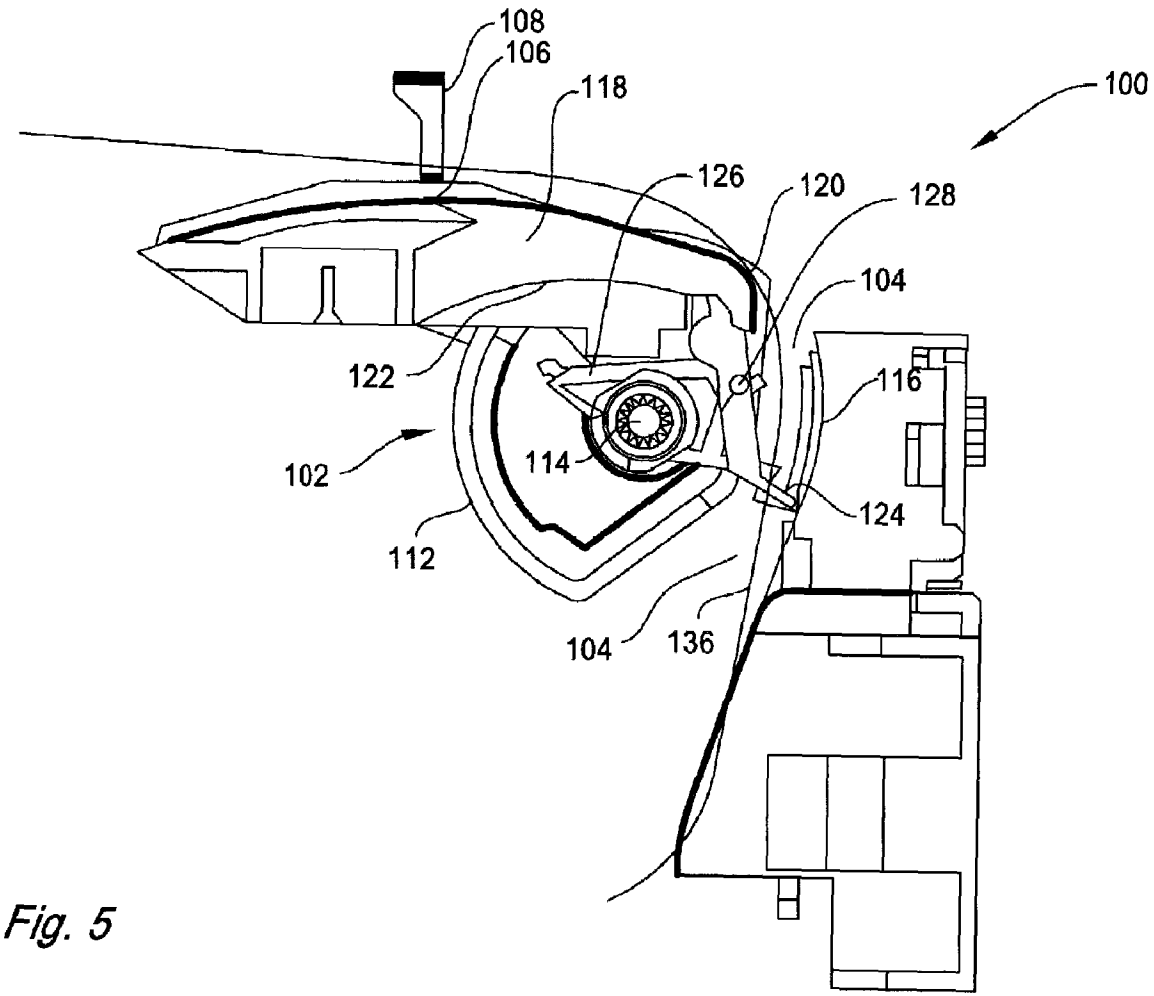

During anticlockwise rotation of converger 102, drive wheel 112 frictionally advances media sheet 136 along media path 104 toward print zone 106. As converger 102 completes approximately three-quarters of a full rotation in direction A, kicker pin 128 disengages from cam surface 122 as shown in FIG. 5. This causes spring-biased kicker 124 to pivotably extend into media path 104 where it contacts, and is deflected by, media sheet 136.

Figure 6:
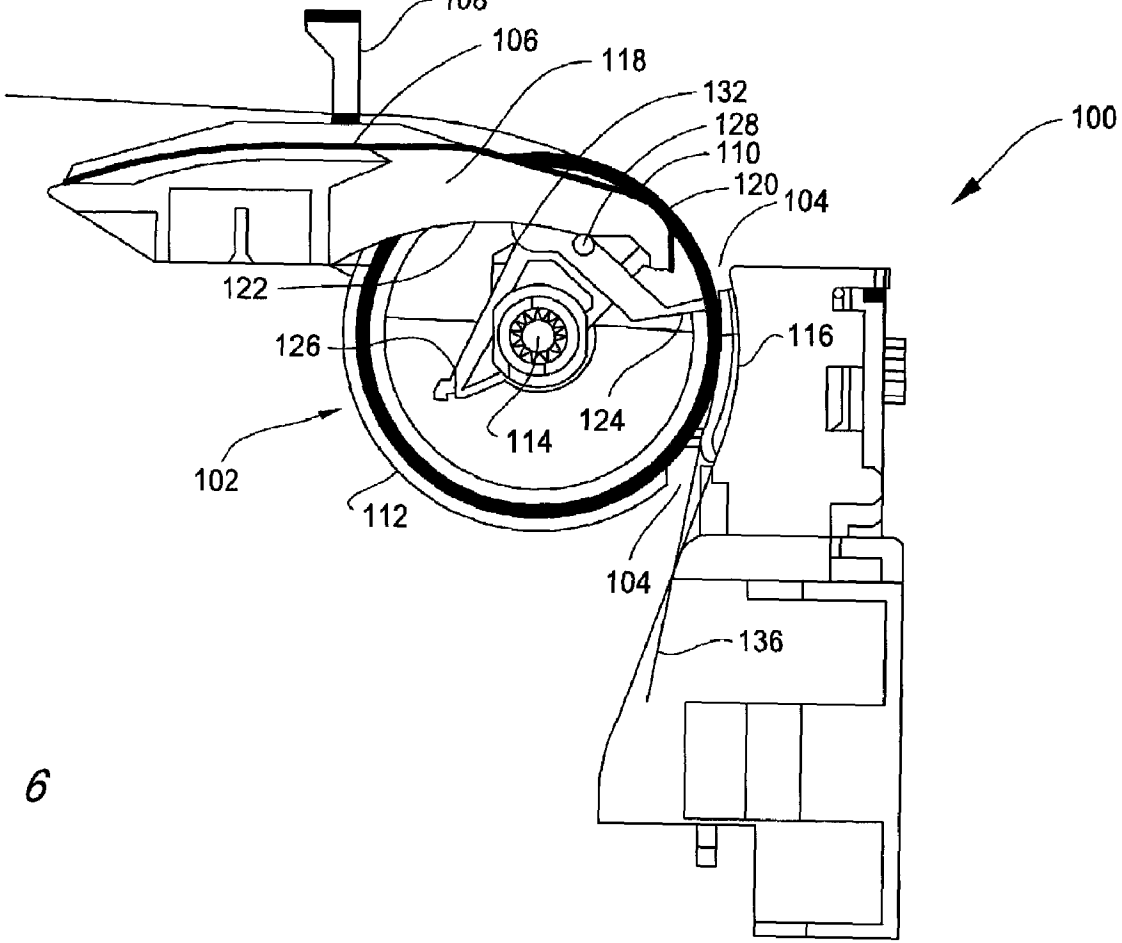

As the top of media sheet 136 enters print zone 106, kicker pin 128 re-engages cam surface 122 to pivotably retract kicker 124 to the home position out of contact with media sheet 136, as shown in FIG. 6. This prevents any contact between kicker 124 and media sheet 136 during printing.

Figure 7:
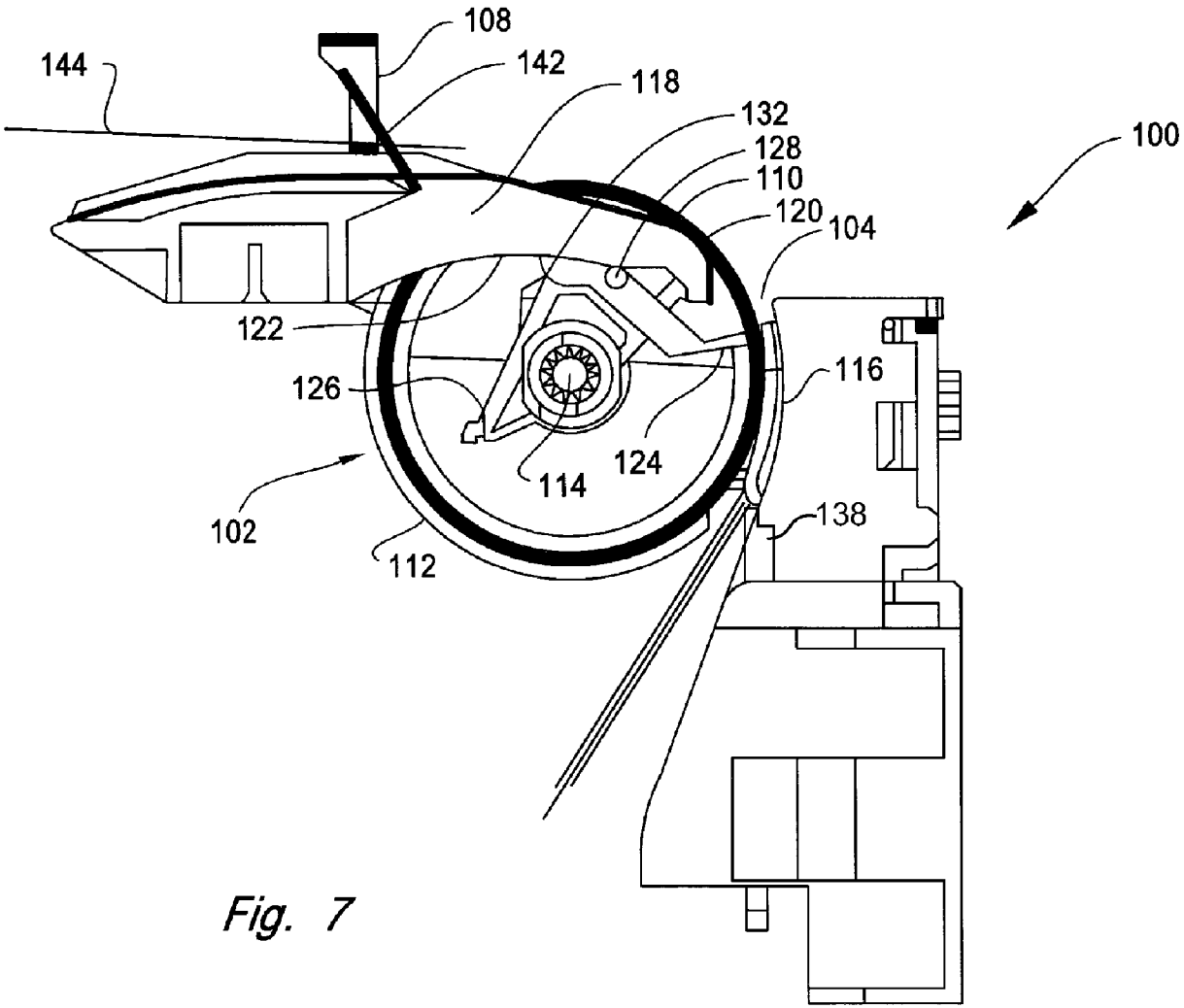
FIGS. 7 to 9 are a sequential series of side elevation views showing the kicker system of FIG. 1 in various positions as the kicker kicks multiple media sheets out of the media path.
Figure 8:
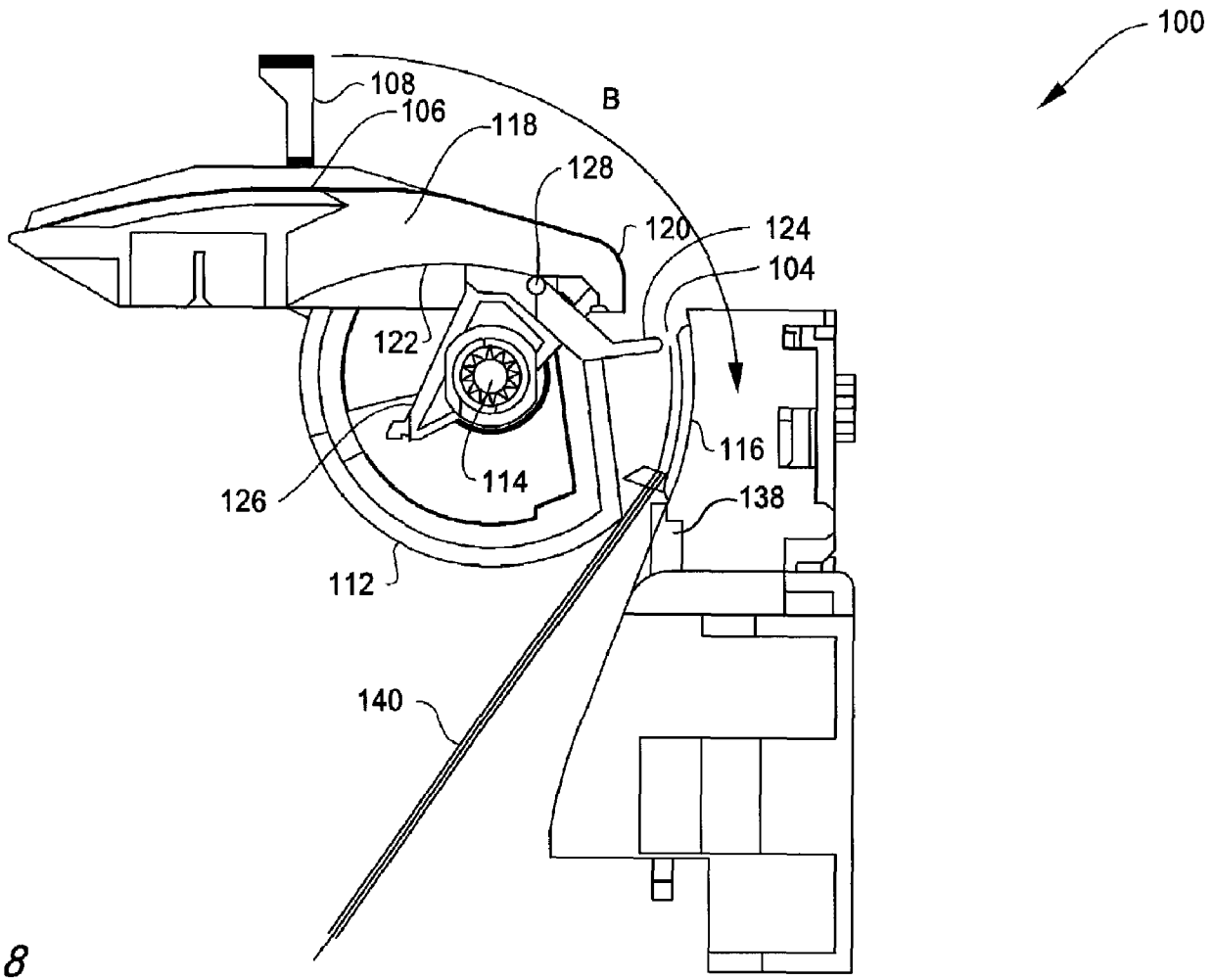

The specific sequence of steps involved in the operation of the kicker system according to the illustrated embodiment when a multiple pick occurs will now be described starting with FIG. 7. The kicking sequence is initiated when a handoff sensor 138 detects multiple media sheets 140 entering media path 104 between drive wheel 112 and guide surface 116. After a top-of-form sensor 142 detects that printed media sheet 144 has exited print zone 106, converger 102 is counter-rotated in a clockwise direction shown by arrow B in FIG. 8. Counter-rotation of converger 102 starts with kicker 124 pivoted by cam surface 122 into the retracted home position out of media path 104.

Figure 9:
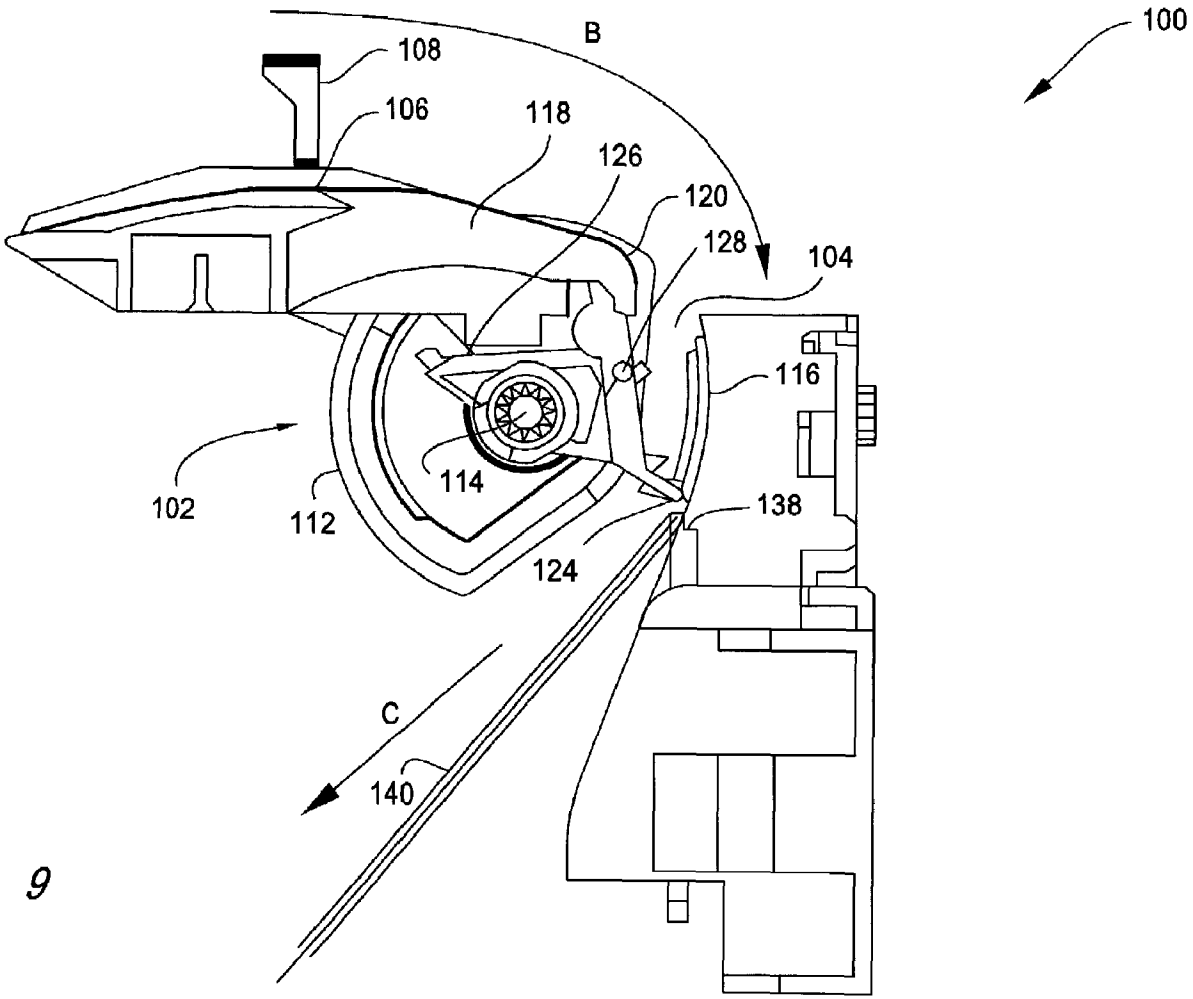

As converger 102 continues to rotate in direction B, kicker pin 128 disengages from cam surface 122. This causes spring-biased kicker 124 to pivotably extend out into media path 104, as shown in FIG. 9. Clockwise rotation of converger 102 in the direction of arrow B continues until actuated kicker 124 contacts multiple media sheets 140 and kicks them out of media path 104 in the direction shown by arrow C toward the input tray (not shown). The kicking sequence is completed by rotating converger in an anticlockwise direction to return kicker 124 to the retracted home position. Thereafter, normal operation of converger 102 can continue until a further multiple pick is detected.

Figure 10:
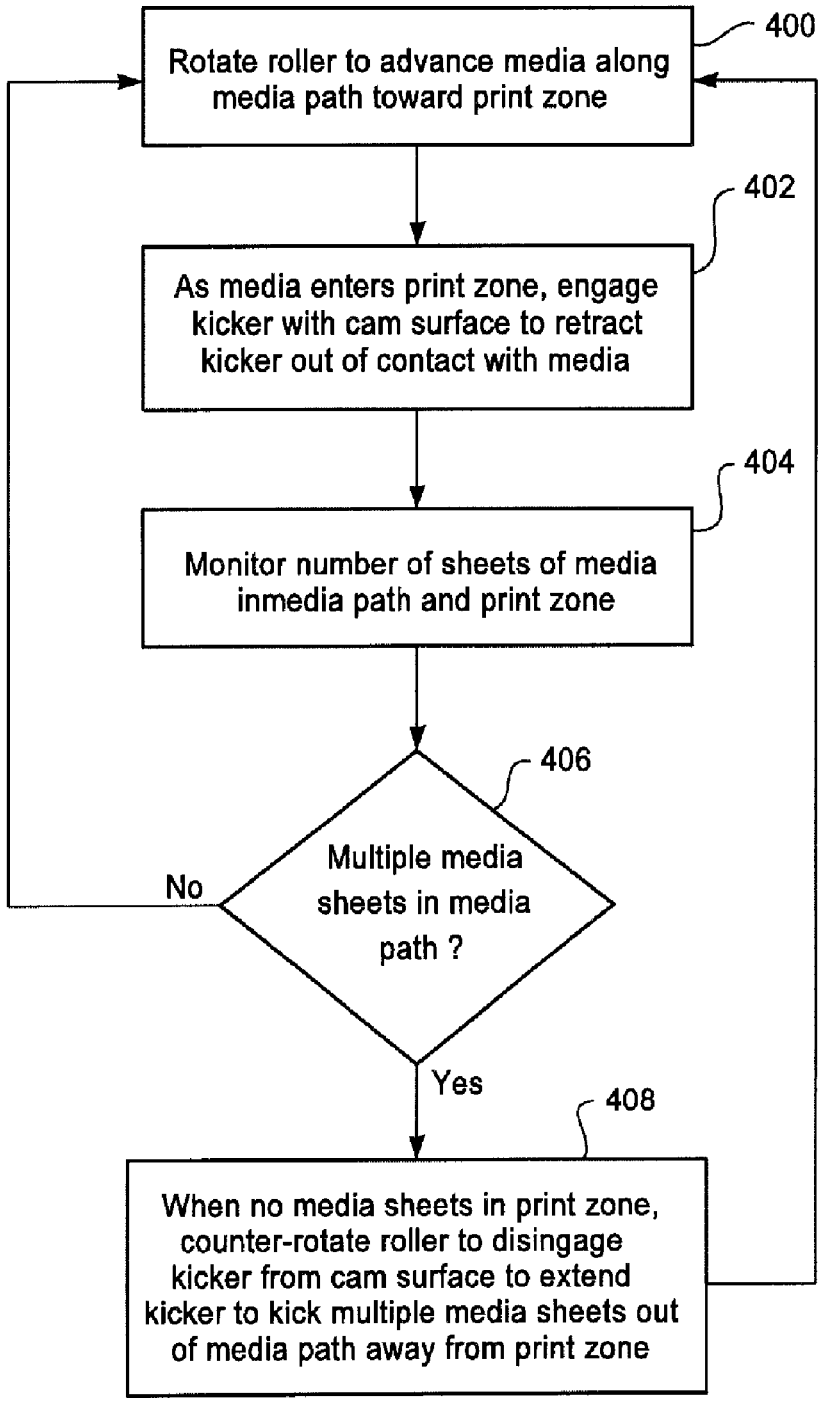
FIG. 10 is a flow chart of the operation of the kicker system according to an embodiment of the present invention.

The operation of the kicker system is further illustrated by the flow chart of FIG. 10. As described above with reference to the hardware in FIGS. 1-9, the kicker is supported on a rotatable roller to pivot transverse to the rotational axis of the roller. The operational cycle begins at step 400 by rotating the roller to advance media along a media path toward a print zone. As media enters the print zone, the kicker engages with a cam surface at step 402 to thereby pivotably retract the kicker out of contact with media in the media path and the print zone. Then at step 404, the number of sheets of media in the media path and the print zone is monitored. If, at step 406, multiple media sheets enter the media path, the roller is counter-rotated at step 408 when there are no media sheets in the print zone to disengage the kicker from the cam surface to thereby pivotably extend the kicker to kick the multiple media sheets out of the media path away from the print zone. The cycle continues by returning to step 400 to advance the next media along the media path toward the print zone.

It will be appreciated that the illustrated embodiment of the kicking system according to the present invention allows the kicker to be selectively actuated by controlling the relative rotation of the converger and the cam surface. Further, the amount of kicking distance can be varied by varying the amount of rotation of the converger.

It will also be appreciated that the illustrated embodiment allows the kicker to be actuated only when a multiple pick occurs. In normal single pick operation, the illustrated embodiment prevents any contact between the kicker and media during printing to thereby minimise or eliminate print defects and skewing that otherwise might be caused by drag between the kicker and media sheet.

Those skilled in the art will appreciate that the invention described herein is susceptible to variations and modifications other than those specifically described. It is to be understood that the invention includes all such variations and modifications which fall within its spirit and scope.

What is claimed is:

1. A kicker system comprising:

a rotatable roller for advancing media along a media path toward a print zone;

a kicker for kicking media in the media path away from the print zone, wherein the kicker is mounted on the roller for pivotal movement transverse to the rotational axis of the roller; and a cam surface configured to engage the kicker during a portion of a rotation of the roller to thereby pivotably retract the kicker out of the media path;

wherein the kicker can be selectively actuated by controlling the relative rotation of the roller and the cam surface.

2. The system of claim 1, wherein rotating the roller advances media toward the print zone and as media enters the print zone the cam surface engages the kicker to pivotably retract the kicker out of contact with media in the media path and the print zone.

3. The system of claim 2, wherein counter-rotating the roller disengages the kicker from the cam surface to thereby pivotably extend the kicker to kick media in the media path away from the print zone.

4. The system of claim 3, wherein the roller comprises a pick roller or a converger roller.

5. The system of claim 4, wherein the converger roller comprising at least one guide wheel and at least one drive wheel mounted on a rotatable shaft, wherein the guide wheel is spaced apart from a guide surface to define the media path therebetween.

6. The system of claim 5, wherein the guide wheel is cylindrical and is rotatably mounted on the converger shaft.

7. The system of claim 6, wherein the drive wheel is generally D-shaped and is fixedly mounted on the converger shaft.

8. The system of claim 7, wherein the cylindrical guide wheel has a radius R1 and the arcuate portion of the generally D-shaped drive wheel has a radius R2, where R2>R1, and wherein the arcuate portion of the drive wheel is concentric with the guide wheel.

9. The system of claim 8, wherein the converger roller comprises a plurality of guide wheels mounted adjacent a corresponding plurality of drive wheels.

10. The system of claim 9, wherein the guide surface is configured to be partially circumferential with the outer surface of the cylindrical guide wheel and concentric therewith.

11. The system of claim 10, wherein the kicker is pivotably supported in a frame fixedly mounted on the converger shaft and a proximal end of the kicker is attached to the frame by a spring so that the kicker is spring biased to extend into the media path.

12. The system of claim 11, wherein the kicker comprises a pin positioned to slidably and pivotably engage with the cam surface during the portion of the rotation of the converger roller.

13. The system of claim 12, wherein the cam surface is provided on an inner surface of a media guide projection, and wherein the guide projection has an outer surface configured to communicate with the media path to guide media toward the print zone.

14. The system of claim 13, further comprising a controller for controlling the rotation of the converger roller in response to first and second sensors, wherein the first sensor detects when a single sheet of media exits the print zone and the second sensor detects when multiple sheets of media enter the media path.

15. The system of claim 14, wherein the controller actuates the kicker if the second sensor detects multiple media sheets only after the first sensor detects the single media sheet has exited the print zone.

16. A method of actuating a kicker supported on a rotatable roller to pivot transverse to the rotational axis of the roller, the method comprising the steps of:

rotating the roller to advance media along a media path toward a print zone;

as media enters the print zone, engaging the kicker with a cam surface to thereby pivotably retract the kicker out of contact with media in the media path and the print zone;

monitoring the number of sheets of media in the media path and the print zone;

if multiple media sheets enter the media path, counter-rotating the roller when there are no media sheets in the print zone to disengage the kicker from the cam surface to thereby pivotably extend the kicker to kick the multiple media sheets out of the media path away from the print zone.

17. The method of claim 16, wherein the roller is a pick roller or a converger roller.

* * * * *